US005957077A

United States Patent [19]

Marolda

[11] Patent Number: 5,957,077

[45] Date of Patent: Sep. 28, 1999

[54] GUIDE TUBE BEND FLUID BEARING

[75] Inventor: Victor J. Marolda, Salem, Conn.

[73] Assignee: The United States of America as Represented by the Secretary of the Navy, Washington, D.C.

[21] Appl. No.: 08/863,096

[22] Filed: May 23, 1997

[51] Int. Cl.[6] ..... B63B 21/16

[52] U.S. Cl. ..... 114/254; 242/615.11

[58] Field of Search ..... 242/615.11, 615.12; 254/389; 384/12; 114/242, 244, 253, 254

[56] References Cited

U.S. PATENT DOCUMENTS 4,705,583 11/1987 Zuber ..... 242/615.11
4,903,907 2/1990 Yokajty et al. ..... 242/615.11

*Primary Examiner*—Ed Swinehart
*Attorney, Agent, or Firm*—Michael J. Mcgowan; Prithvi C. Lall; James M. Kasischke

[57] ABSTRACT

Disclosed is an apparatus for deploying and retrieving a towed array from a vehicle. This apparatus includes a cable storage device positioned inside the vehicle hull. A winch is positioned adjacent this cable storage device for paying out the array and retrieving the array from and to the cable storage device. The array extends in a first length from the cable storage device to the winch to a hull exit point. A fluid bearing is positioned between the first and second length of the array. This fluid bearing comprises an internal arcuate cable conveying passageway and a fluid inlet for introducing a fluid to said internal cable conveying passageway so as to reduce stress and friction on the array.

9 Claims, 4 Drawing Sheets

GUIDE TUBE BEND FLUID BEARING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to marine towing apparatus and more particularly to a fluid bearing for towed array bends.

(2) Brief Description of the Prior Art

It is known in the art that sonar capabilities of submarines or surface ships can be provided or enhanced by means of towed arrays of electrical or optical cables having acoustical sensors disposed along their length and at their terminal ends. Such arrays can be deployed by assemblies for paying out the cable and for subsequently reeling in and storing the cable. Such a system is described, for example, in U.S. Pat. No. 5,263,431.

Referring to FIG. 1, another somewhat different conventional apparatus for deploying or retrieving a towed array is shown. It will be seen that a towed array 10 passes through a number of bends 12 which in the art are frequently referred to as "roller boxes". This conventional apparatus also includes a winch 14 which includes capstan drive 16, capstan idler 18 and capstan drive motor 20. Adjacent the winch 14, there is a storage drum 22 and storage drum motor 24.

During retrieval, the capstan drive 16 rotates to reel in the array 10 to the capstan idler 18 and then back to the capstan drive 16, usually for a plurality of turns. During deployment, the array 10 is reeled into the storage drum 22. After a plurality of turns around the capstan idler 18, the cable is urged around the bend 12. It then passes through guide tube 30 to the aft of the submarine or other vehicle. It will thus be understood that the array 10 extends in an oblique first length from the storage drum 22 to the winch 14 and to the bend 12. At the bend 12, the direction of the array is changed and it extends rearwardly in a longitudinal second length 30. The array 10 extends to where its direction is changed again in additional bends 36 and 38 before extending through the hull of the submarine at exit 44 to deployed array 46.

Referring to FIG. 2, there is shown a prior art roller box type of bend 12. It will be seen that this roller box includes an inner guide 48 wherein a number of rollers such as roller 50 are transversely mounted. Inner guide 48 is mounted by brackets 54. The array 10 is directed through and retained within a guide tube 26. The rollers 50 are positioned on the inside of each bend in contact with array 10 to reduce friction that would normally occur between the array and the inside bend radius of the guide tube 26 when the array is being retrieved. By means of this arrangement, the desired degree of bend may be introduced into the cable 10. The use of the rollers, however, such as roller 50 introduces point loading on the array, with high stresses and associated fatigue damage inflicting upon the array components. This is due primarily to the rollers inability to completely support the array from "flattening".

A need, therefore, exists for a means for changing the direction of a towed array cable which does not introduce such point loads and consequently avoids such high stresses and associated reduce reliability.

SUMMARY OF THE INVENTION

It is the object of the present invention to provide a simple and reliable means for changing the direction of a cable.

It is a further object that such means has no moving parts and reduces component stresses and friction on the array.

Accordingly, the present invention provides apparatus for deploying and retrieving an array from a vehicle. The array has a cable with acoustical sensor means deployed along its length and end. This apparatus includes a cable storage means positioned inside the vehicle hull. A winch means is positioned adjacent this cable storage means for paying out and retrieving cable from and to the cable storage means. The array extends in a first oblique length from the cable storage means to the winch means and then in a second generally longitudinal length to a hull exit means. A fluid bearing is positioned between the first oblique length and the second longitudinal length of the array. This fluid bearing comprises an internal arcuate cable conveying passageway and means for introducing a fluid to said internal cable conveying passageway. The apparatus of this invention may also include one or more additional fluid bearings for changing the direction of the array at other positions.

Also encompassed with the present invention is a fluid bearing for changing the direction of a cable in a deployed array system. The fluid bearing has opposed side walls, a cable supporting arcuate base having a plurality of orifices positioned between said side walls and an internal fluid containing chamber. Fluid conveying means between said fluid containing chamber and the orifices in the cable supporting arcuate base are also included.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE PREFERRED EMBODIMENT

Figure 1:
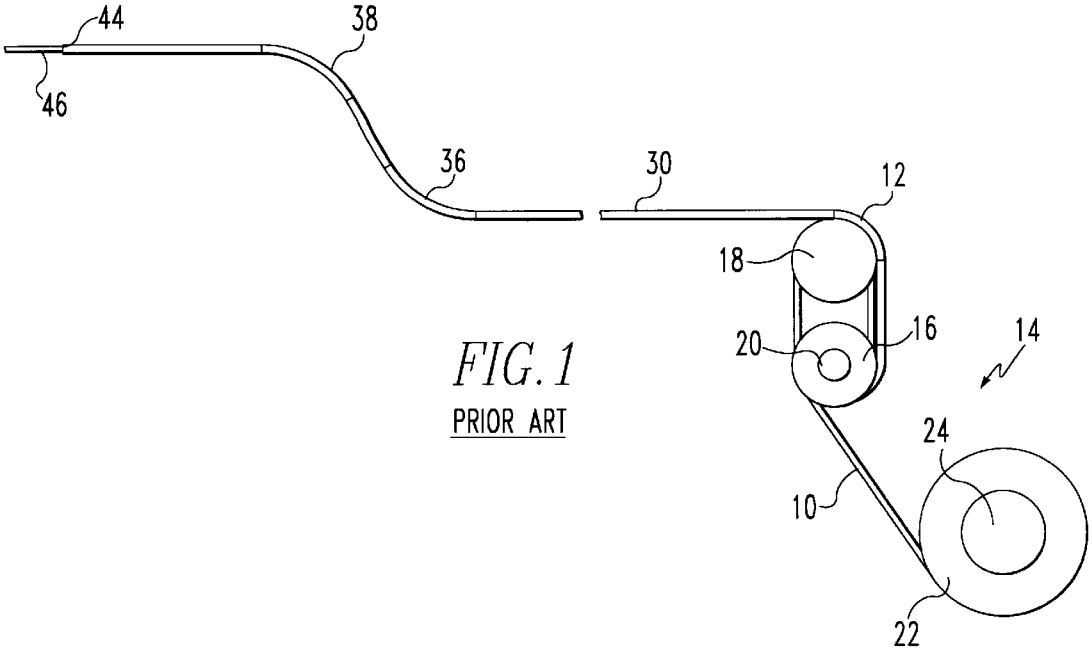
FIG. 1 PRIOR ART
FIG. 1 is a diagrammatic view of a prior art apparatus for paying out and retrieving an array which may be modified for use with the apparatus of the present invention.
Figure 2:
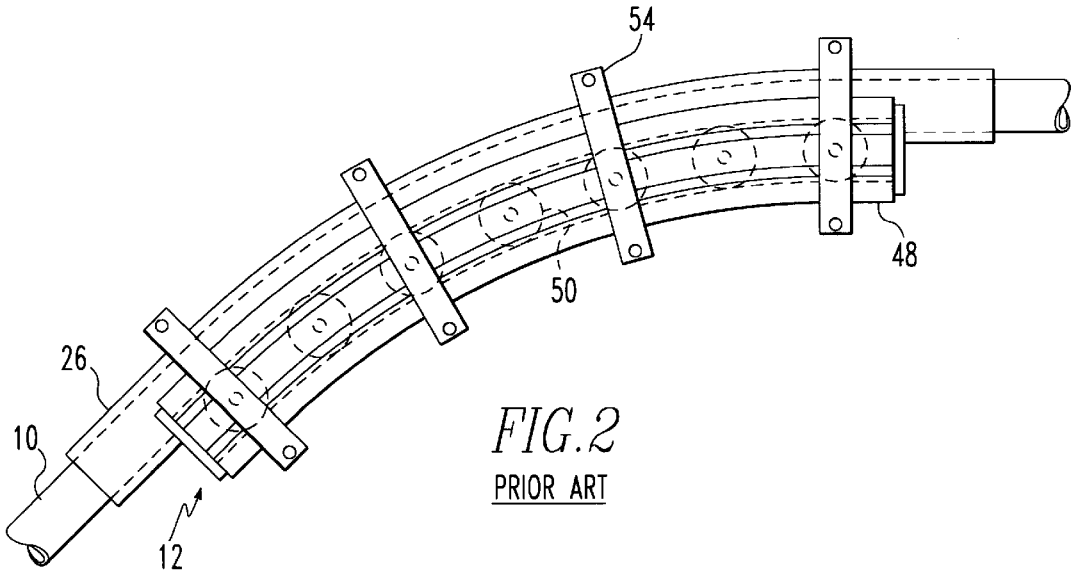
FIG. 2 PRIOR ART
FIG. 2 is a detailed plan view of the roller box section of the prior art apparatus shown in FIG. 1.
Figure 3:
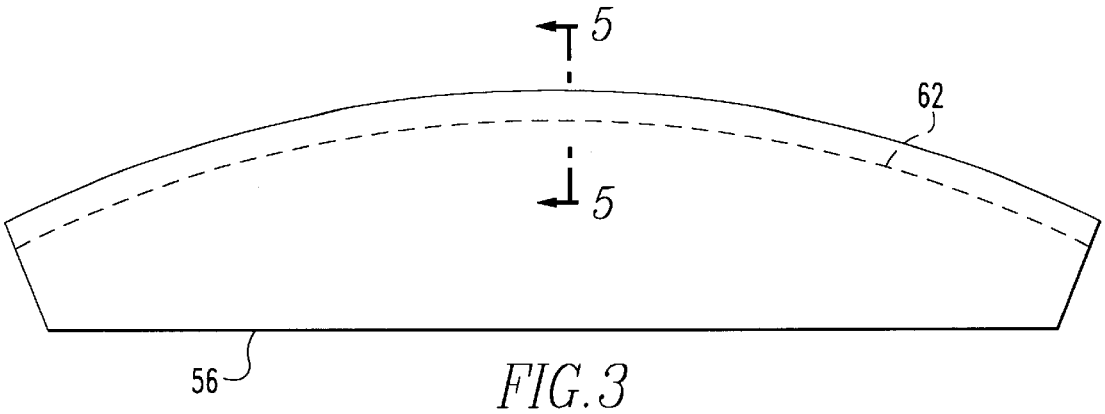
FIG. 3 is a side elevational view of a fluid bearing which may be used in a preferred embodiment of the apparatus of the present invention.
Figure 4:
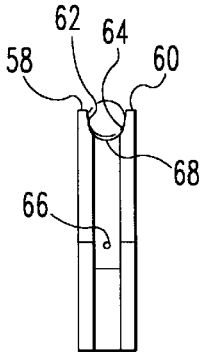
FIG. 4 is a top plan view of the fluid bearing shown in FIG. 3.
Figure 5:
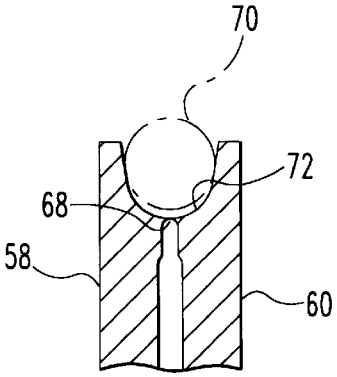
FIG. 5 is a cross sectional view through 5—5 in FIG. 3.

Referring to FIGS. 3, 4, 5, 6 and 7 there are shown side, top and end views of a new towed array bend fluid bearing 56 which is preferably made of a plastic material. It has a pair of opposed side walls 58 and 60 and an arcuate base wall 62 which is interposed between the side walls 58 and 60 to form a groove 64. There are also a plurality of orifices in base wall 62 as at orifices 66 and 68. The placement of the engaged array 70 is shown in phantom lines in FIGS. 5 and 7. The orifices 68 provide a fluid, preferably water, which provides a fluid film 72 and 92 (FIGS. 5 and 7) on which the cable 70 (FIG. 7) can glide. For conventional array sizes, water would be provided through the combined orifices 66, 68 at a rate in the preferred range of 6 gal./min. to 10 gal./min.

Figure 6:
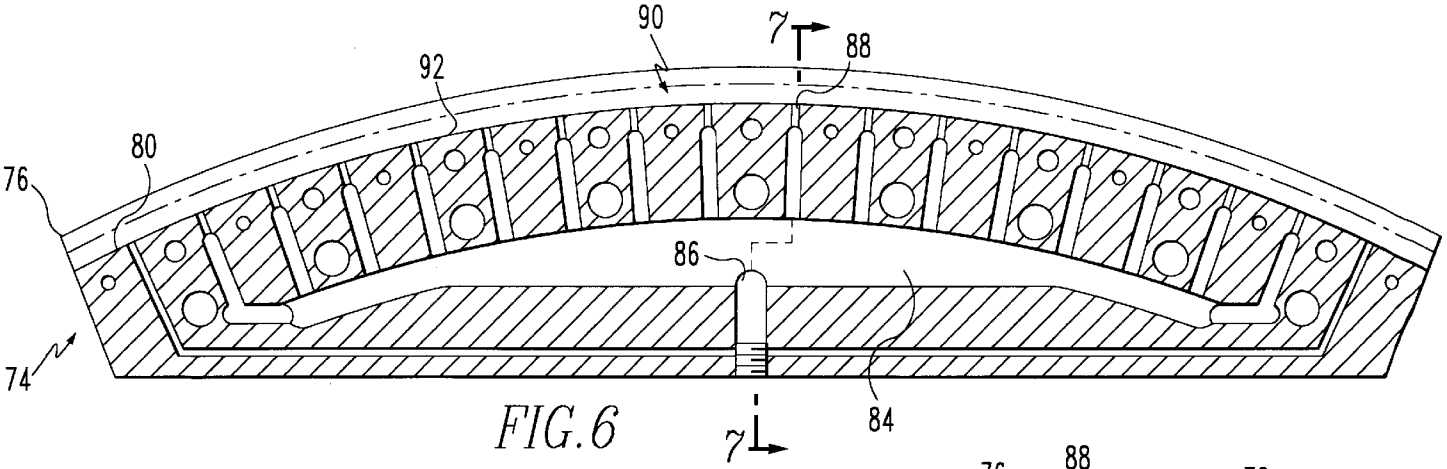
FIG. 6 is a vertical cross sectional view of another fluid bearing which may be used in another preferred embodiment of the present invention.
Figure 7:
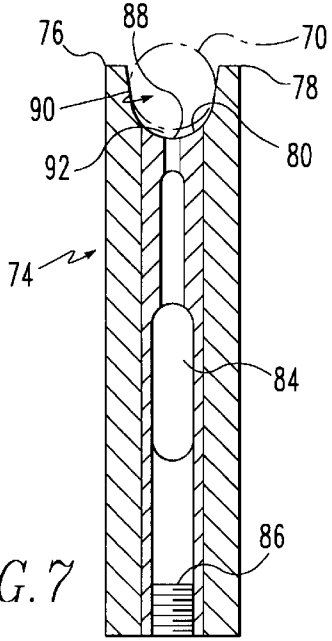
FIG. 7 is a cross section through 7—7 in FIG. 6.

Referring to FIGS. 6 and 7, cross sectional views of another fluid bearing 74 illustrating additional detail are shown. As was stated above, opposed walls 76 and 78 and arcuate base wall 80 form a groove in which the array 70 (FIG. 7) is emplaced. The fluid bearing 74 also has an interior fluid chamber 84 which is provided with water or other fluid by means of fluid inlet 86. A number of orifices 88 are disposed along the groove 90. The continuous flow of water through orifices 88 into groove 90 provides a film of water 92 on which the array 70 (FIG. 7) can glide.

It will be understood that the fluid bearing described herein may be substituted for the roller box in the systems for paying out and retrieving an array or cable described above. Specifically, the fluid bearing, like the roller box, will serve to change the direction of the array between the oblique first length of the array leaving the winch 14 and the longitudinal second length of array approaching the hull exit 44. Otherwise, however, the elements of the apparatus of the present invention for paying out and retrieving the array may be the same as the prior art systems described above and the above description of the prior art systems above are incorporated into this disclosure of the present invention by reference.

Figure 8:
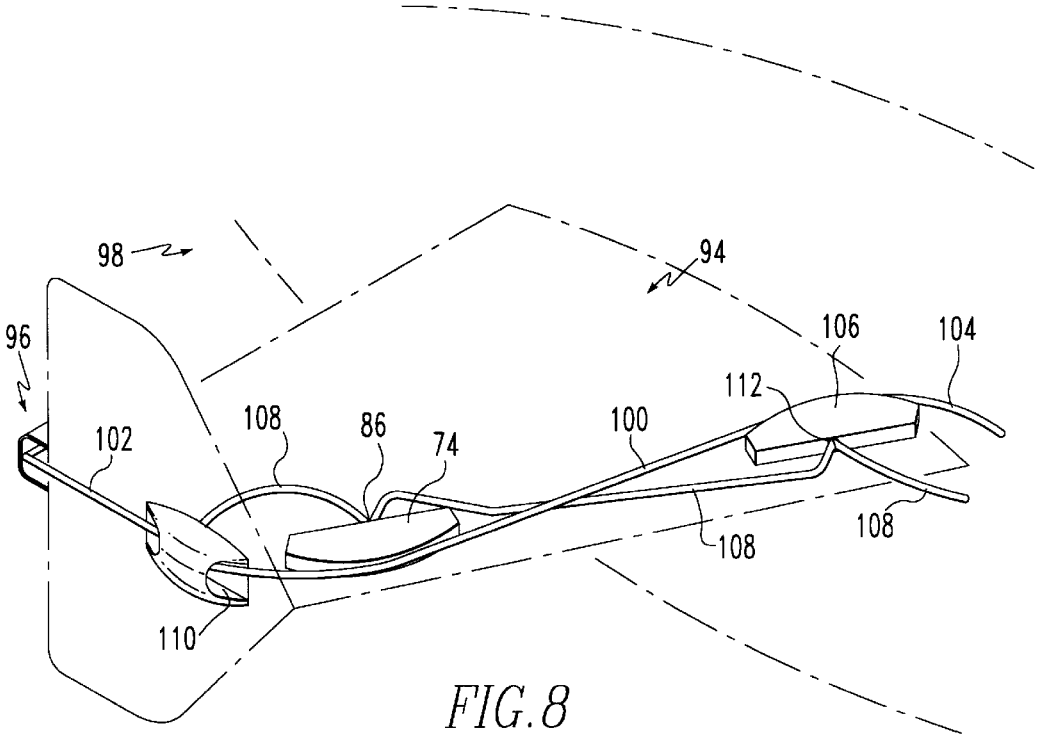
FIG. 8 is a perspective view of part of an apparatus for paying out and retrieving a cable array which is a preferred embodiment of the present invention.

Referring to FIG. 8 it will be understood that the fluid bearing may also be employed at other positions where it is desired to change the direction of the array 70. In this embodiment, the fluid bearing 74 is employed to change the direction of the array 70 at a position on the diving plane support 94 adjacent the exit 96 at the aft end of the hull 98. It will be seen that the fluid bearing 74 is used to change array direction between an oblique length 100 of array and another longitudinal length 102. Forward of the oblique length 100 there is another longitudinal length 104 which extends forward to the fluid bearing (not shown) adjacent the winch (not shown) and storage drum (not shown). Another fluid bearing 106 is positioned between longitudinal length 104 and oblique length 100 to change array direction at that point. Referring particularly to the fluid bearing 74, its fluid which is water is supplied through inlet 86 which is fed by water line 108 which obtains water at scoop 110. The water supply can also be directly supported on the shaft seal water supply already present in the ballast tank. It will be seen that water line 108 also feeds fluid bearing 106 through inlet 112 and extends forward so as to be able to feed the other fluid bearings employed in the system such as the one adjacent the winch.

This fluid bearing bend is simple and reliable, having no moving parts. The bend reduces stress and friction on the array. The lifetime of current arrays often is determined by the roller box system. The new bend does not contribute to array failure and the life expectancy of arrays is determined by factors other than the bend system.

While the present invention has been described in connection with the preferred embodiments of the various elements, it is to be understood that other similar embodiments may be used or modifications and additions may be made to the present described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for deploying and retrieving an array from a vessel with a cable exit means comprising:

a cable storage means positioned inside the vessel;

a winch means positioned adjacent said cable storage means for paying out and retrieving a cable of the array to said cable storage means;

a guide tube having a first length and a second length, said first length extending from said cable storage means to said winch means in a first direction, said second guide tube length extending from said winch means to said cable exit means in an angularly different second direction; and a fluid bearing positioned between the first length of the guide tube and the second length of the guide tube at said winch means, said fluid bearing comprising a housing having an internal arcuate cable conveying passageway and means for introducing a fluid to said cable conveying passageway.

2. The apparatus of claim 1 wherein the fluid bearing housing has elongated arcuate base and opposed side walls and said opposed side walls define a groove therebetween.

3. The apparatus of claim 2 wherein said groove defined in said housing supports positioning of an array cable therein.

4. The apparatus of claim 3 wherein said arcuate base has a plurality of orifices therein.

5. The apparatus of claim 4 wherein the fluid bearing has an internal fluid containing chamber formed in said housing.

6. The apparatus of claim 5 further comprising a fluid conduit connecting each of the orifices to the internal fluid containing chamber.

7. The apparatus of claim 6 further comprising:

said internal fluid chamber having a fluid inlet therein; and a fluid supply tube joined to said fluid inlet.

8. The apparatus of claim 7 further comprising a scoop joined to said fluid supply tube.

9. A fluid bearing comprising:

opposed side walls;

a cable supporting arcuate base having a plurality of orifices therein positioned between said side walls;

a fluid supply tube having an inlet end and an outlet end;

a scoop joined to said fluid supply tube inlet end for funneling fluid into the fluid supply tube;

an internal fluid containing chamber having a fluid inlet formed therein and connected to said fluid supply tube outlet end; and fluid conveying means positioned between said fluid containing chamber and said orifices in the cable supporting arcuate base.

* * * * *